US006935427B1

(12) United States Patent
Billingsley

(10) Patent No.: US 6,935,427 B1
(45) Date of Patent: Aug. 30, 2005

(54) PLUNGER CONVEYED PLUNGER RETRIEVING TOOL AND METHOD OF USE

(75) Inventor: Steven Mark Billingsley, Blanco, OK (US)

(73) Assignee: Samson Resources Company, Tulsa, OK (US)

( * ) Notice: Subject to any disclaimer, the term of this patent is extended or adjusted under 35 U.S.C. 154(b) by 97 days.

(21) Appl. No.: 10/603,897

(22) Filed: Jun. 25, 2003

(51) Int. Cl.[7] ..... E21B 31/12
(52) U.S. Cl. ..... 166/301; 166/99; 166/105; 166/162
(58) Field of Search ..... 166/301, 98, 99, 166/68, 105, 105.2, 153, 162, 243

(56) References Cited

U.S. PATENT DOCUMENTS 2,878,754 A 3/1959 McMurry ..... 417/60
3,051,242 A 8/1962 Chamberlain et al. ..... 166/185
4,295,528 A * 10/1981 Carmody ..... 166/382
4,693,308 A 9/1987 Luke et al. ..... 166/55.1
4,984,969 A 1/1991 Fineberg ..... 417/58
5,984,009 A 11/1999 DiFoggio ..... 166/250.13
6,032,733 A 3/2000 Ludwig et al. ..... 166/60

* cited by examiner

*Primary Examiner*—Zakiya Walker
(74) *Attorney, Agent, or Firm*—Head, Johnson & Kachigian

(57) ABSTRACT

A wellbore plunger retrieving tool including a substantially cylindrical retrieving plunger body having a reduced diameter top end and an opposed bottom end. The body bottom end has a threaded recess. A plunger receiving collet includes a threaded male top end engageable with the threaded recess and an opposed bottom end with a plurality of extending fingers. The fingers are capable of flexing to engage a downhole stuck plunger.

4 Claims, 5 Drawing Sheets

PLUNGER CONVEYED PLUNGER RETRIEVING TOOL AND METHOD OF USE

BACKGROUND OF THE INVENTION

1. Field of the Invention

The present invention is directed to a plunger conveyed plunger retrieving tool and a method of use. In particular, the present invention is directed to a plunger retrieving tool which is fabricated from existing components and may be conveyed and retrieved without use of wireline or other mechanisms.

2. Prior Art

Wells that produce natural gas also very often produce liquids such as oil or water. Natural gas and liquids flow into a wellbore due to the pressure inside the wellbore being less than the pressure in the surrounding reservoir. This differential pressure is sometimes referred to as "draw down". If the flow rate of natural gas is high enough, the liquids are swept upwards and continuously removed from the wellbore by the velocity of the natural gas.

As the well ages, however, the flow rate of the natural gas will often decrease to the point where the velocity is insufficient to continuously remove the liquids from the wellbore. As the liquid "falls back", a liquid level begins to form in the wellbore. This liquid level tends to exert a hydrostatic pressure. As the liquid level (and the hydrostatic pressure) increase, the pressure inside the wellbore at the formation face begins to increase. Since flow from the reservoir into the wellbore is governed by the differential pressure between the reservoir and the wellbore, any increase in pressure due to this liquid column reduces the flow from the reservoir into the wellbore. This is referred to as "liquid loading". Once the hydrostatic pressure caused by the fluid column inside the wellbore is equal to the pressure in the reservoir, flow from the reservoir decreases to zero. The well is then described as being "loaded up".

To alleviate this loaded up condition, various forms of artificial lift exists. Artificial lift is a broad term describing many methods that allow a well to be produced after natural flow has decreased. One such form of artificial lift is called "plunger lift". Plunger lift is a form of artificial lift whereby the "plunger" is utilized to provide a solid interface between the natural gas and the liquid so as to prevent the liquid from falling back and accumulating in the reservoir. The plunger itself comes in various sizes and designs but includes a cylindrical metal object that has a diameter slightly smaller than the internal diameter of the wells production tubing. This close tolerance in diameters allows the plunger to move up and down the length of the tubing, but the tolerance is close enough that fluid that accumulates in the tubing is swept upward by the plunger. The plunger lift is a form of "intermittent" artificial lift so designated because the well is cycled through intermittent periods of being shut in and then opened up for production. These cycles are controlled automatically with valves and controllers typically supplied as part of the overall plunger lift installation.

The general operation of the plunger lift system is as follows:

1. A spring is installed in the bottom of a production tubing to cushion the fall of the plunger and prevent it from falling out the bottom of the tubing.
2. Surface equipment is installed on the well as follows:
   a. a "catcher" is installed on the wellhead to catch the plunger when it arrives at the surface.
   b. a controller is installed that senses the arrival of the plunger and controls a valve on the flow line. This flow line valve is the mechanism by which the well is either shut in or opened to flow.
3. Upon initial installation, the plunger is installed in the catcher and allowed to fall by gravity to the spring at the bottom. There is enough tolerance in diameters that the plunger will fall through fluid that has accumulated in the tubing.
4. The well is shut in at the surface using an automatic flow line valve. Pressure is then allowed to build on the well.
5. The surface controller can be programmed to open and close the flow line valve based on numerous parameters, such as time or pressure. Upon reaching a selected parameter, the flow line valve is opened. Since pressure is built on the well, flow occurs from the wellbore through the opened flow line valve. The plunger ascends from the bottom of the tubing, driven by the gas pressure below it. The plunger travels at a high velocity and its close tolerance allows minimal fluid to slip past the plunger as it travels up the tubing, pushing a column of fluid ahead of it. The fluid is removed from the tubing through the flow line as the plunger arrives at the surface.

Flow is allowed until the controller senses a program parameter, such as time or pressure, at which time the controller signals the flow line valve to close and the well is shut in. The controller also releases the plunger from the catcher. The plunger falls to the spring on the bottom and the cycle is repeated.

During the course of the artificial lift operations, it is not unusual for the plunger to become stuck in the tubing. This may be caused by a number of factors. There may be a defect in the plunger or a failure in the tubing. Solids produced with the reservoir fluids, such as sand or salt, may cause the plunger to become stuck. It will be appreciated that the plunger may be stuck thousands of feet below the surface of the earth.

If the plunger becomes stuck at any time during the artificial lift operations, it may be necessary to employ a company or companies to perform a retrieving operation to retrieve the plunger. This is often described as a "fishing operation".

In a traditional or conventional operation of retrieving or fishing a stuck plunger, a retrieving tool is installed by attaching to the end of a spooled wireline. The retrieving tool is then lowered into the tubing by gravity until it encounters the stuck plunger downhole. The retrieving tool attaches onto a fishing neck of the stuck plunger. The retrieving tool will latch onto the neck in a number of ways including grapples or flexible fingers. The wireline is thereafter pulled from the well with the stuck plunger engaged by the retrieving tool.

Typically, the wireline and specialized retrieving tools are not provided at each wellsite. Instead, various service companies provide this service as needed. The traditional means for retrieving or fishing stuck plunger results in expense for the wells' operator as the wireline operations are provided at a cost by various service companies.

Also in the past, attempts have been made to drop another object down into the well in an effort to dislodge the stuck plunger.

It would be desirable to fabricate a plunger retrieving tool from readily available components.

It would also be desirable to provide a plunger retrieving tool which operates without any wireline or similar mechanism.

It would also be desirable to provide a plunger retrieving tool and method of use that can be quickly and easily employed at a well site and then supplemented, if necessary, with traditional wireline fishing retrieval techniques.

SUMMARY OF THE INVENTION

The present invention is directed to a plunger conveyed plunger retrieving tool and an accompanying method of use. The device will be used for retrieving a stuck plunger from a wellbore such as a cylindrical production tubing. The plunger operates as a well-pressure propelled piston for assisting flow of fluid from a well and travels between a position at the surface to a downhole position.

The present invention includes a retrieving plunger body adapted by providing a threaded recess in a bottom end of the body. A plunger receiving collet includes a threaded male end which is engageable with the body at the threaded recess. The combined retrieving body and collet will descend by gravity from the surface through the production tubing, down towards the stuck plunger. When the combined retrieving body and collet reach the stuck plunger, the collet having a plurality of extending grapples or fingers will engage the reduced diameter neck of the stuck plunger and also provide a jarring force to the stuck plunger, thereby dislodging the stuck plunger from any stalled position. The combined stuck plunger, the retrieving body and the collet are thereafter raised to the surface by fluid force when the surface valves are opened to permit fluid flow. No wireline or wire spool is required.

If the present invention is utilized and is not successful in raising the stuck plunger to the surface, traditional wireline fishing techniques might thereafter be employed to attach to the reduced diameter neck of the top end of the retrieving body.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
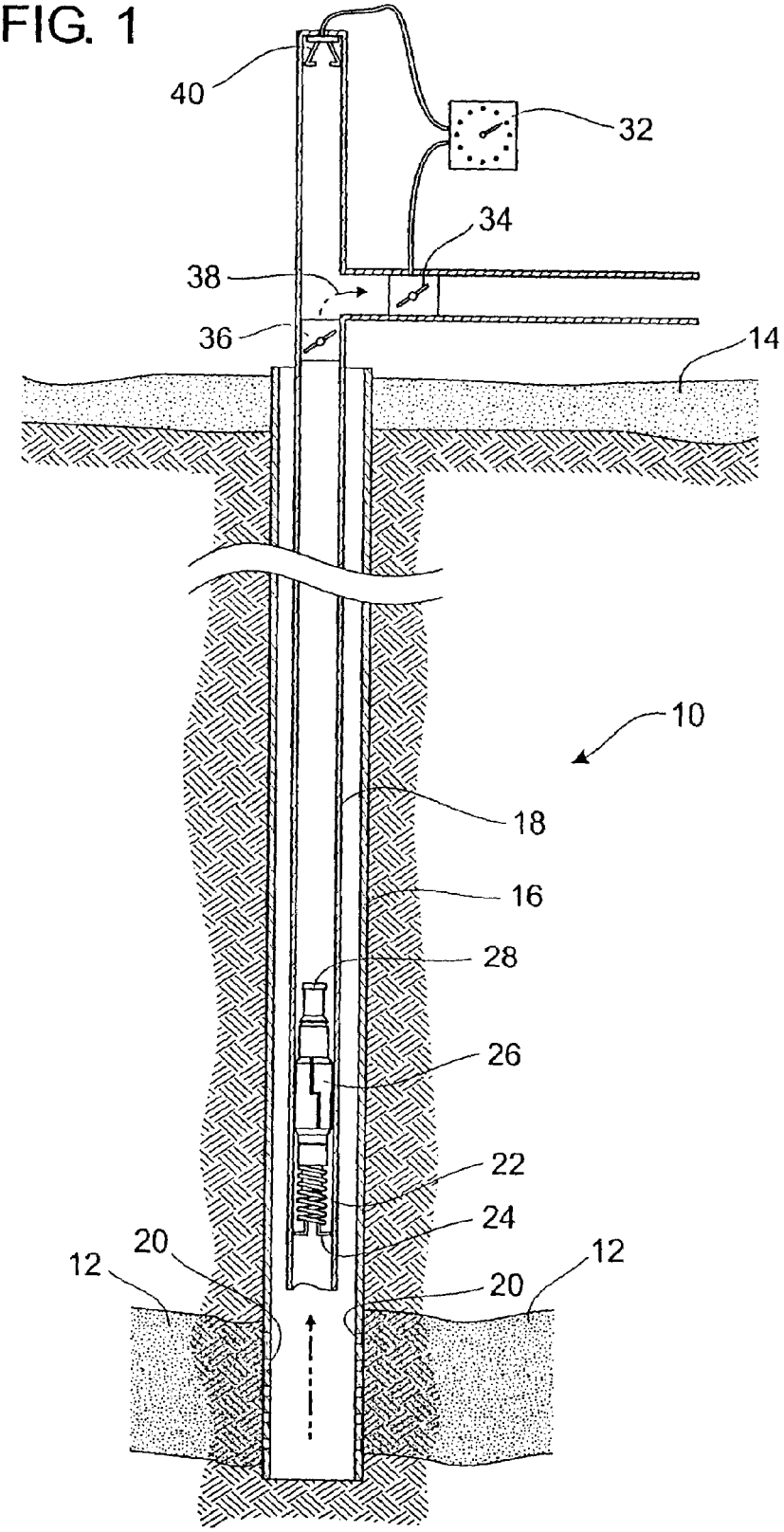
FIG. 1 is a partial, sectional view of a well employing typical artificial lift procedures.

Referring to the drawings in detail, FIGS. 1 through 4 illustrate a sequential method of utilizing the present invention to retrieve a stuck plunger. FIG. 1 illustrates a typical wellbore configuration for a well 10 utilizing artificial lift procedures.

An underground area containing a productive reservoir is illustrated by the shaded area 12 which is beneath the surface 14. In a typical configuration, a wellbore is drilled followed by installation of a production casing 16 shown in cross-section. Interior to the production casing 16 is a cylindrical production tubing 18 which extends to the surface 14. Perforations 20 in the production casing 16 permit and allow fluid flow from the reservoir into the wellbore. The productive reservoir zone may contain natural gas and liquids, such as oil and/or water. A spring, such as coil spring 22, is installed near the bottom of the production tubing and cushions the fall by gravity of a plunger 26. The spring 22 will be retained near the bottom of the production tubing via a tubing stop, a collar stop 24 or a seating nipple in the tubing.

A plunger 26 will typically be a cylindrical metal device having an exterior diameter slightly smaller than the interior diameter of the production tubing 18. The plunger does not create a fluid tight seal so that pressure in the production tubing is equalized. The plunger 26 also includes a reduced diameter neck 28.

In artificial lift installations, a surface controller 32 maybe operated to control operation of a valve at the surface 14. The well 10 may be cycled between periods of being shut in and periods of being opened for production. During production, fluid flow travels in the path shown by arrow 38.

The plunger 26 operates as a well-pressure propelled piston for the purpose of assisting the flow of fluid from a well. The plunger travels between the position shown in FIG. 1 and the surface 14. A so-called catcher 40 may be utilized in a well head to catch the plunger 26 when it arrives at the surface.

Figure 2:
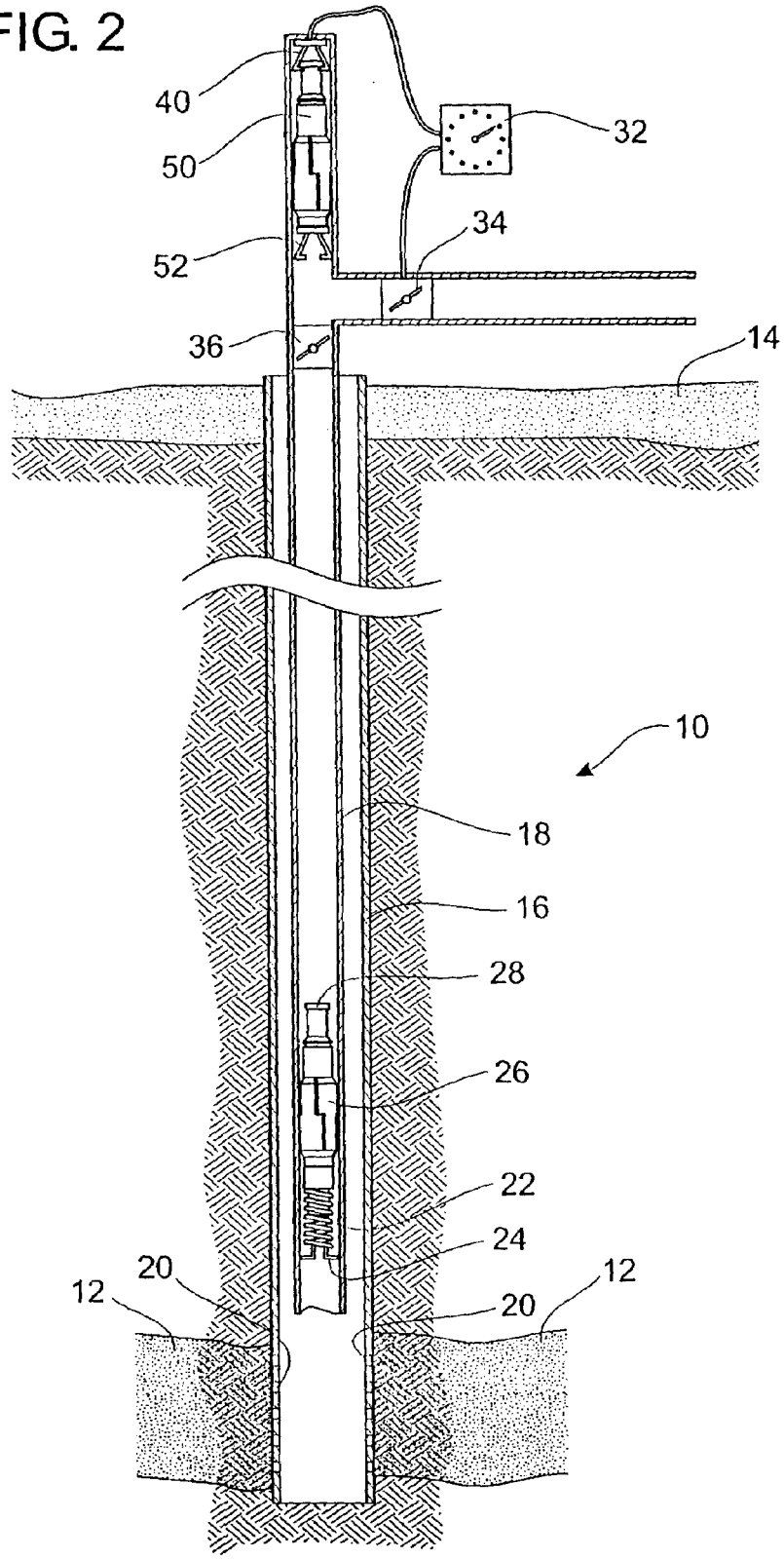
FIGS. 2 through 4 illustrate the sequential operation of a plunger conveyed plunger retrieving tool and a procedure or method of use in accordance with the present invention.
Figure 3:
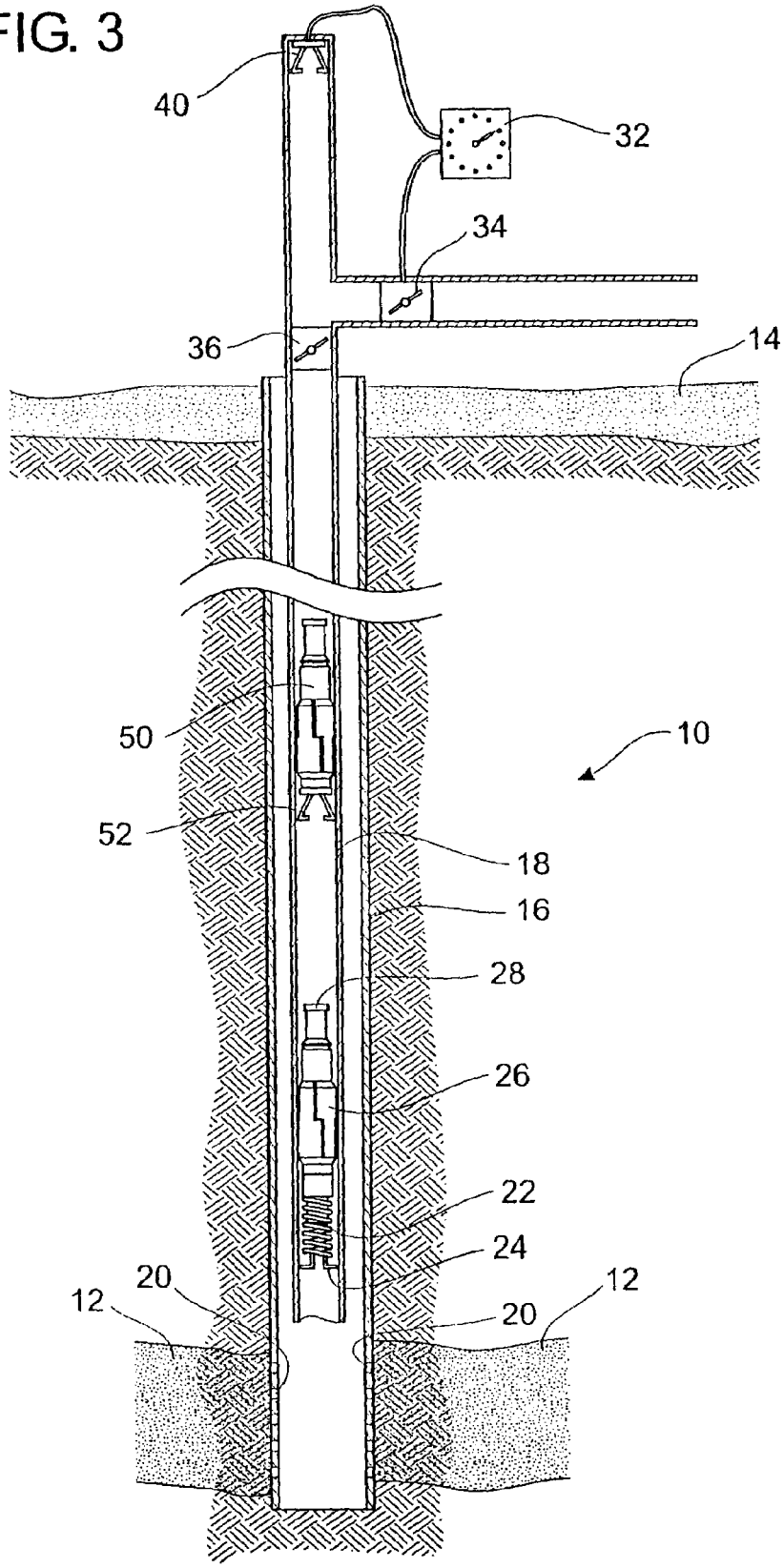
Figure 4:
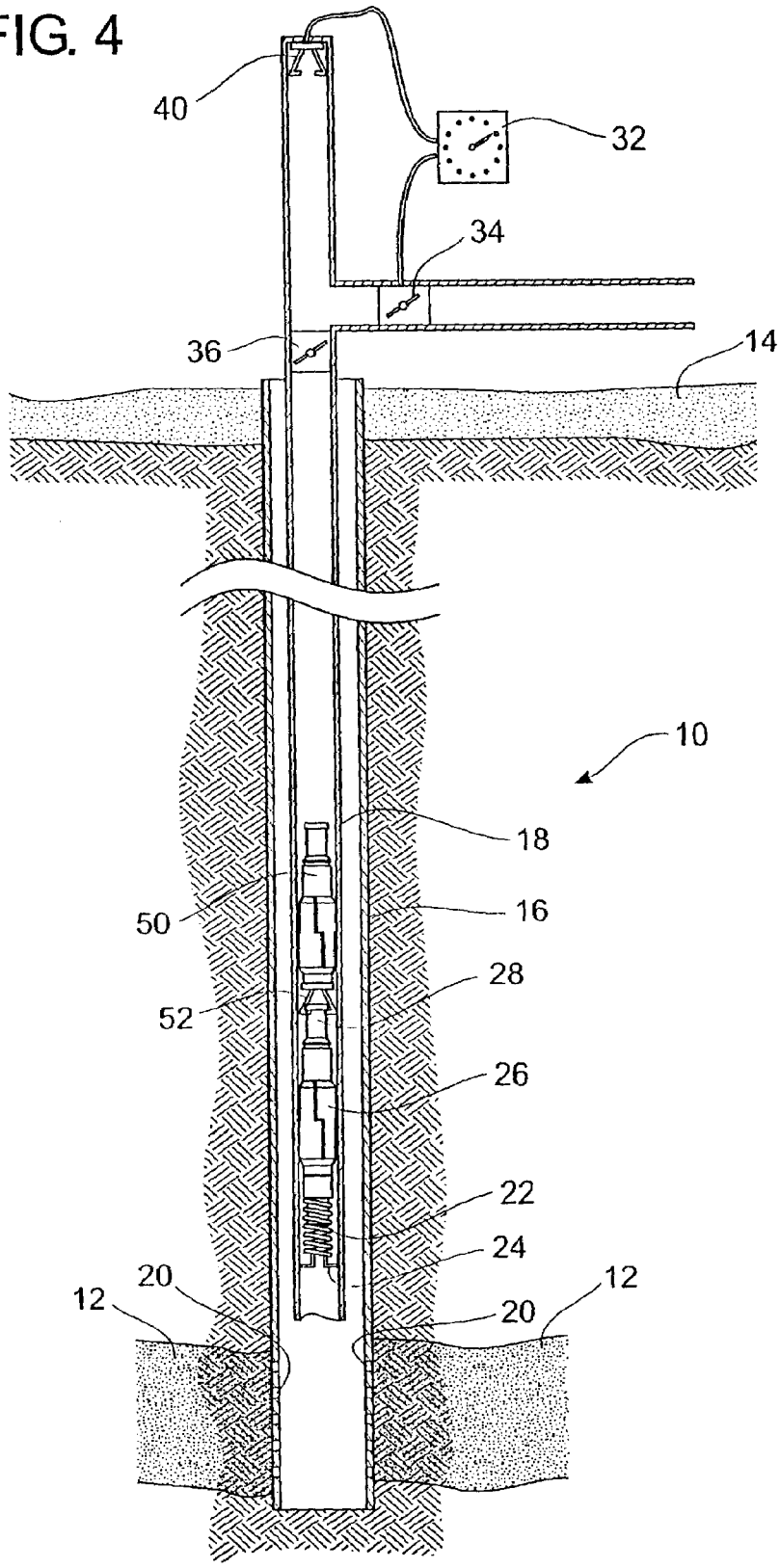

FIGS. 2, 3 and 4 sequentially illustrate one preferred application of the present invention to retrieve a plunger 26 stuck downhole.

A retrieving plunger body 50 is adapted for the present invention by providing a threaded recess (not visible) in a bottom end of the body 50. The retrieving body 50 maybe fabricated for the present purpose or adapted by modifying an existing plunger. A plunger receiving collet 52 having a threaded male end (not visible) is engaged with the body 50 at the threaded recess. The combination of the retrieving plunger body 50 and the collet 52 are inserted at the well head and held in place at the surface by the catcher 40.

FIG. 3 illustrates the next sequence in the operation of the process of the invention. The surface controller 32 may be operated so that the catcher 40 releases the combined retrieving body 50 and the collet 52 so that it descends by gravity from the surface 14 through the production tubing 18, down towards the stuck plunger 26. When the combined retrieving body 50 and collet 52 reach the stuck plunger 26, the collet, having a plurality of grapples or fingers, engages the reduced diameter neck 28 of the stuck plunger 26 and also provides a jarring force to the stuck plunger 26, thereby dislodging the stuck plunger 26 from any stalled position.

FIG. 4 illustrates the combined retrieving body 50 and collet 52 connected to the reduced diameter neck 28 of the stuck plunger 26. The combined stuck plunger 26, the retrieving body 50 and the collet 52 are thereafter raised to the surface by force created from gas pressure when the valves 36 and 34 are opened to permit fluid flow. No wireline or wireline spool is required.

Figure 5:
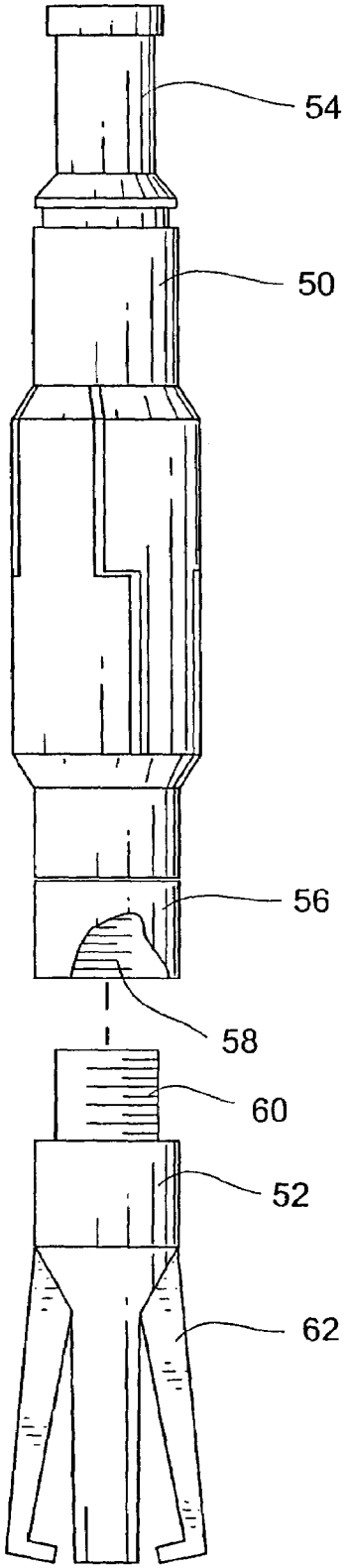
FIG. 5 shows an exploded view of a plunger retrieving body and a plunger retrieving collet in accordance with the present invention exploded for clarity.

FIG. 5 illustrates the combined retrieving body 50 and the collet 52 apart from the well.

The retrieving body 50 includes a top end 54 having a reduced diameter neck and an opposed bottom end 56. The bottom end 56 includes a threaded recess 58 (partially cut away for clarity). The collet 52 includes a threaded male top end 60 which is engageable with the threads 58 of the retrieving body 50. The plunger receiving collet 52 also includes an opposed bottom end having a plurality of grapples or fingers 62. The fingers 62 are capable of flexing in order to engage a downhole stuck plunger (not shown in FIG. 5).

It will be appreciated that if the present invention is not successful in raising a stuck plunger to the surface, traditional wireline fishing techniques may be employed to attach to the reduced diameter neck of the top end 54 of the retrieving body 50.

Whereas, the present invention has been described in relation to the drawings attached hereto, it should be understood that other and further modifications, apart from those shown or suggested herein, may be made within the spirit and scope of this invention.

What is claimed is:

1. A wellbore plunger retrieving tool which comprises:

a retrieving plunger body having a top end and an opposed bottom end wherein said retrieving plunger body is substantially cylindrical;

said body top end having a reduced diameter neck;

said body bottom end having a threaded recess;

a plunger retrieving collet having a threaded male top end engageable with said threaded recess and an opposed bottom end having a plurality of fingers wherein said fingers flex to engage a downhole stuck plunger;

means to deliver said retrieving plunger body from a surface downhole to said stuck plunger and to dislodge said stuck plunger by a jarring force wherein said body has a mass to descend and cause said jarring force solely by gravity; and means to deliver said retrieving plunger body and said stuck plunger from downhole to said surface by fluid pressure wherein said body has a diameter slightly less than a diameter of tubing.

2. A wellbore plunger retrieving tool as set forth in claim 1 wherein said retrieving plunger body is adapted and modified from an existing plunger.

3. A method of retrieving a stuck plunger from a well, wherein said stuck plunger has a reduced diameter neck, which method comprises:

providing a threaded recess in a retrieving plunger body;

connecting said plunger body with a plunger receiving collet having a plurality of fingers;

lowering said retrieving plunger body and said collet by gravity in said well until said fingers engage said stuck plunger; and raising said stuck plunger, said body, and said collet by force created from gas pressure.

4. A method of retrieving a stuck plunger as set forth in claim 3 including the additional step of adapting said retrieving plunger body from an existing plunger.

* * * * *